United States Patent [19]

DeGennaro

[11] Patent Number: 4,467,477

[45] Date of Patent: Aug. 28, 1984

[54] FOLDABLE WEARING APPAREL

[76] Inventor: Alfred A. DeGennaro, 1492 Ocean Ave., Sea Brite, N.J. 07760

[21] Appl. No.: 372,912

[22] Filed: Apr. 14, 1982

[51] Int. Cl.[3] ..... A41D 1/00

[52] U.S. Cl. ..... 2/94; 2/108; 2/84

[58] Field of Search ..... 2/108, 85, 94, 85, 84, 2/88

[56] References Cited

U.S. PATENT DOCUMENTS 4,138,742 2/1979 Meeks ..... 2/84

4,307,470 12/1981 Ezell ..... 2/108

*Primary Examiner*—Doris L. Troutman

[57] ABSTRACT

Disclosed is an article of wearing apparel provided with cooperating and complementary attaching members to be secured to one another after the article of wearing apparel is formed into a compact unit.

9 Claims, 26 Drawing Figures

FOLDABLE WEARING APPAREL

BACKGROUND OF THE INVENTION (a) Field of the Invention

This invention relates to an article of clothing which can be folded into a cushion or rolled into an easy-to-carry garment.

(b) Discussion of the Prior Art

Spectators at sporting events often have to contend with hard seats and bleachers as well as changes in weather conditions which often necessitate the unexpected use of outerwear. The problem is not confined to spectators but is shared by people who engage in outdoor sporting activities such as boating, fishing, hunting, camping, et cetera, who seldom have anything comfortable to sit on while resting and often face changes in weather conditions requiring either the use of outerwear or the removal and carrying of outerwear which is being worn.

The problem is not confined to outdoor activities but is shared by anyone who desires an article of clothing which can be utilized as a cushion or an easy-to-carry garment.

SUMMARY OF THE INVENTION

The garment which is the subject matter of the present invention is provided with cooperating and complementary attaching or fastening members which are secured so that the article of wearing apparel is formed into a compact unit as referred to above.

As a solution to this and other problems, I have invented a unique garment which can be folded into a cushion, pocketbook, briefcase or easy-to-carry garment. When folded as pocketbook or briefcase, the compartments of the pocketbook or briefcase may also be pockets of the garment. This allows easy access to the items stored in the compartments when they are being used as a pocketbook or briefcase.

The various features of novelty which characterize the invention are pointed out with particularity in the claims annexed to and forming a part of this specification. For a better understanding of the invention, its operating advantages and specific objects obtained by its use, reference should be had to the accompanying drawings and descriptive matter in which there is illustrated and described a preferred embodiment of the invention.

DETAILED DESCRIPTION OF THE DRAWINGS

Figure 1:
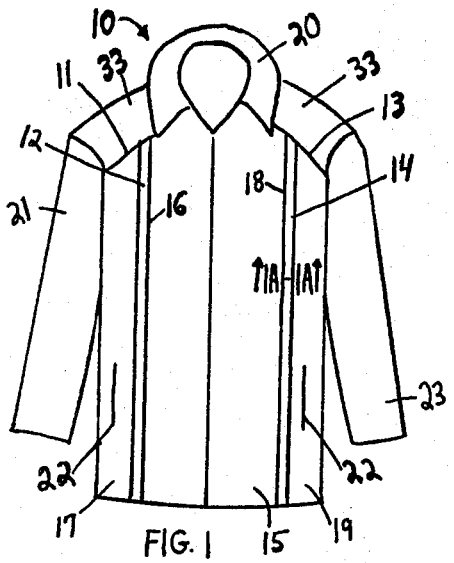
FIG. 1 is a front view of coat 10 fully extended.

FIG. 1 is a front view of the coat 10 as worn by user. It should be emphasized that the garment is illustrative and the invention is not limited to coats but embraces capes, jackets, parkas, et cetera. The materials from which the garment is to be made are also not intended to be limited and may include all natural and man-made fibers or combinations thereof. The garment may also be waterproof. It should also be noted that for the sake of clarity several garments have been used to illustrate the invention; however, the invention encompasses a single garment which contains any or all of the described features (particularly a garment with a "removable" or "zip-out" lining) which will be subsequently described.

Referring now to FIG. 1, there is illustrated a coat 10, including a lining (not shown) to give it bulk and softness. As shown in FIG. 1, the coat 10 includes strips of material 12 and 14 running from the shoulder seams 11 and 13 to the bottom of the coat. The strip 12 is located on the border line separating the front panel 15 of the coat 10 from its right side panel 17 and strip 14 is located on the border line separating the front of the coat 15 from its left side panel 19. The strips 12 and 14 are attached to the coat 10 along edges 16 and 18, respectively, thereof. The coat also includes such conventional items as collar 20, pockets 22, shoulder region 33 and sleeves 21 and 23.

Figure 2:
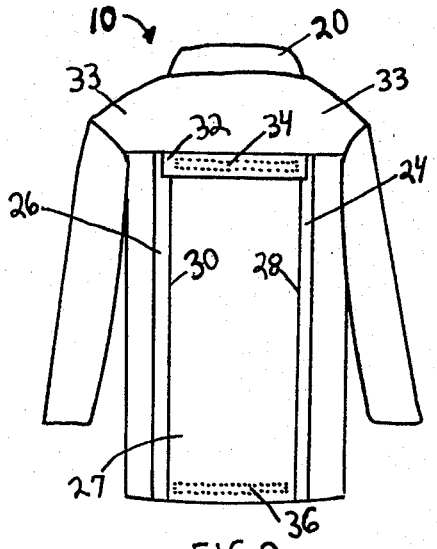
FIG. 2 is a rear view of coat 10 fully extended.

FIG. 2 shows the back of coat 10 and reveals strips of material 24 and 26 which cooperate with strips 12 and 14, respectively, and located along the borders separating the back panel 27 of coat 10 from its left and right side panels, 17 and 19, respectively. The strips 24 and 26 are attached to the coat along edges 28 and 30 respectively, thereof. There is also a strip of material 32 running across the back of coat 10. Preferably, strip 32 is positioned to extend from strips 24 to 26 at the uppermost sections thereof.

Figure 1A:
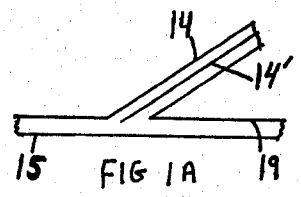
FIG. 1A is a view taken along line 1A—1A of FIG. 1.

As exemplified and illustrated in FIG. 1A, behind each of the strips of material 12, 14, 24 and 26, there is provided cooperating pressure sensitive adhesive material 12', 14', 24' and 26'.

Figure 3:
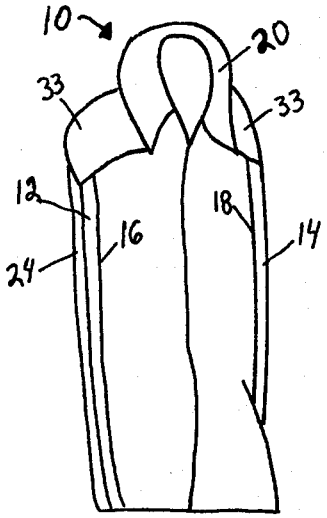
FIG. 3 is a view of coat 10 after the sleeves and sides of the coat have been secured between the front and back panels of the coat.

Referring now to FIG. 3, the sleeves 21 and 23 and the side panels 17 and 19 of coat 10 are pushed between the front and back panels of the coat 10 and secured there by means of joining the cooperating strips of pressure sensitive adhesive material located behind strips 12, 14, 24 and 26. It should be emphasized that the use of a looped pile and mating strip arrangement is merely illustrative and the invention is not limited to such devices. By way of example, Velcro (a registered trademark) pressure sensitive strips may be employed.

As used in this description and in the appended claims the phrase "securable apparel side panel" refers to any side panel of any garment in which the side panel of said article of clothing can be secured between the front and back panels of said garment by fastening means located anywhere below the collar region of said garment.

Figure 4:
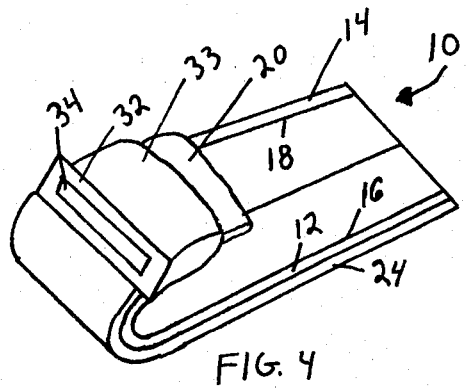
FIG. 4 is an illustration of how the coat can be further folded to form a more compact unit which can be utilized as a cushion.

Once the sides are secured between the front and back of the garment, the resulting shape can be utilized as a cushion. The coat may be further folded as illustrated in FIG. 4, with collar 20 and shoulder region 33 folded down to meet the front waist area. Behind strip of material 32 is pressure sensitive adhesive material 34. A complementary strip of adhesive material 36 for adhesive 34 is located on the inside of the base of the back of coat 10 in a centered location.

Figure 5:
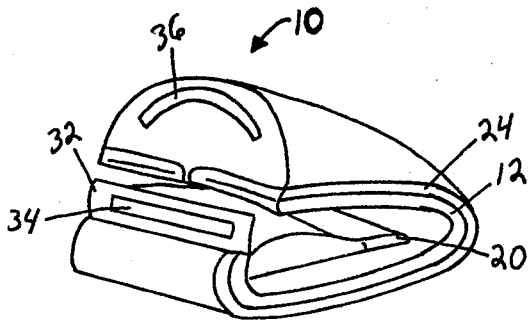
FIG. 5 shows the bottom of coat 10 being folded over the collar area.
Figure 6:
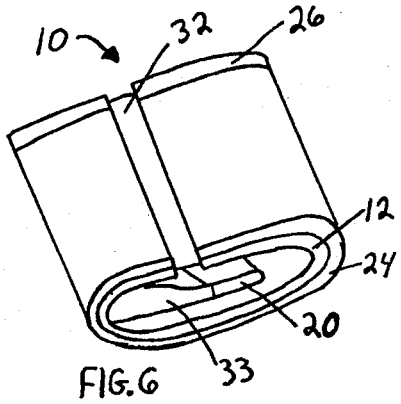
FIG. 6 is a view of the coat completely folded.

Referring to FIG. 5, the bottom of the coat is then folded over the shoulder region 33 and collar 20 until meeting strip 34 which is located beneath strip 32. Material strip 32 is then inserted over the front and side panels of coat 10 and the fastening means 34 and 36 are attached together. FIG. 6 illustrates the completed process and the resulting shape to be utilized as a cushion or other resting or support device.

Figure 7:
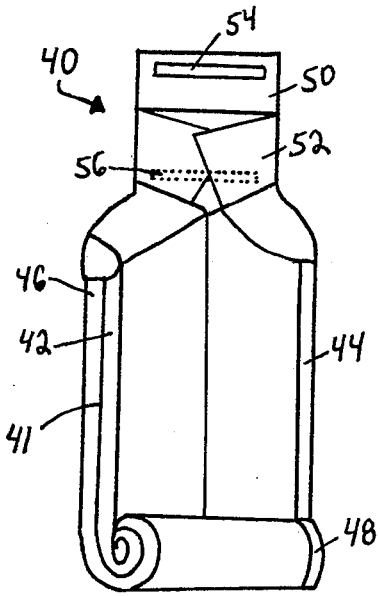
FIGS. 7–9 show the sequence of another garment being rolled into a more compact shape (coat 40)

FIG. 7 illustrates a garment, generally indicated as 40, without a lining which would be utilized for giving bulk and softness to the folded garment. The securable apparel side panel 41 can also be utilized in a garment of this nature to create an extremely compact and easy to carry garment. Strips of material 42, 44, 46 and 48, which are similar to strips 12, 14, 24 and 26 of coat 10, cover adhesive strips 42', 44', 46' and 48' (not shown), respectively, and are used to secure the side panels and sleeves between the front and back panels of the garment to form apparel side panel 41. Collar 52 has been turned up. Material flap 50 is attached to collar 52. A strip of pressure sensitive adhesive 54 is positioned on the flap facing with the front of the coat. A complementary strip of pressure sensitive adhesive material 56 is located on the back of collar 52 facing with the back of the coat. The strips of adhesive material 54 and 56 are positioned at distances from each approximately equal to the circumference of the rolled garment. As illustrated by FIG. 7, the bottom of the coat is being rolled toward collar 52 and flap 50 to produce the compacted item.

Figure 8:
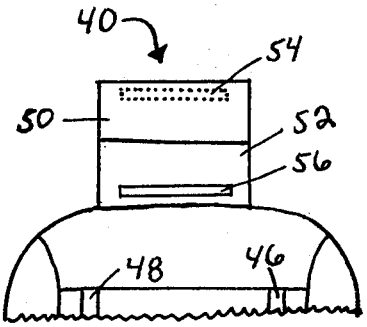

FIG. 8 is a view of the back of the coat 40 illustrating the flap 50 and collar 52. It will be noted that in this embodiment, strips 54 and 56 are oppositely displaced. However, as will be subsequently discussed, such opposite orientation is not necessary for the invention.

Figure 9:
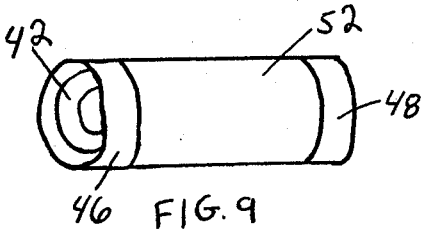

FIG. 9 illustrates the garment after it has been entirely rolled and strips of adhesive 54 and 56 have been secured. Flap 50 can be concealed when the garment is being worn by folding it under the collar and securing the strips of adhesive material 54 and 56 to each other without causing the slightest discomfort to one wearing the garment.

An ordinary garment which has been secured in a rolled position will have many rough edges which are subject to ripping, tearing or fraying. By rolling the garment as illustrated above, the garment is surrounded by flat fabric which is more suitable for sporting uses, traveling, et cetera. This flap technique need not be used in combination with a securable apparel side panel as any process of folding which will allow the rolled garment to be surrounded by the flap and collar area will significantly reduce the number of jagged edges.

Figure 10:
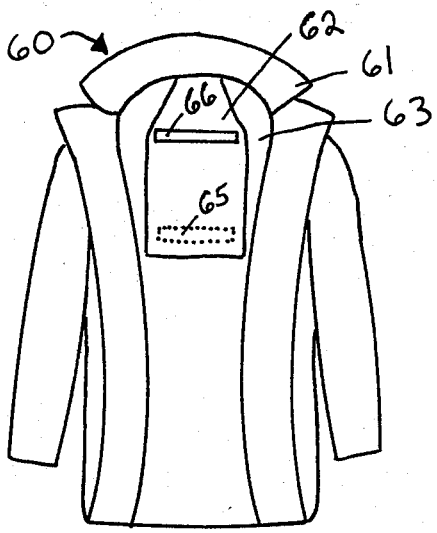
FIG. 10 shows a front view of coat 10, fully extended.

FIG. 10 illustrates coat 60, also without a bulky lining, but which has an elongated flap 62 capable of completely surrounding the rolled garment. Here both fastening devices 65 and 66 which will secure the coat in the rolled position are located on the flap 62, again being spaced from each other approximately the circumference of the anticipated rolled or compacted garment. The flap conveniently hangs down the inside back of the coat when it is being worn without causing discomfort to the wearer.

Figure 11:
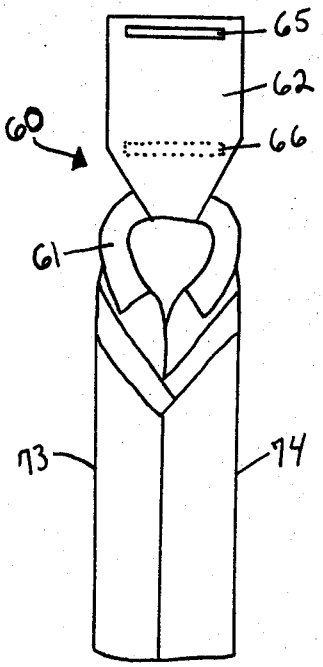
FIGS. 11 and 12 show an alternative method of securing a garment into a compact rolled shape.

FIG. 11 shows flap 62 extended out of the coat 60 and exposing material adhesive 65 which faces the front of the coat. Material strip 66 is located on the reverse side of flap 62 and faces the back of the coat and is shown here by dotted lines. FIG. 11 also shows the sides of the coat folded in toward the middle creating a narrower bodyline which is approximately equal to the width of the flap 62. The bottom of the coat can now be rolled to the top of the flap 62 in a similar manner as that illustrated in FIG. 7.

It should also be noted that the resultant sides 73 and 74 could again be folded toward the center of the coat creating a more narrow bodyline, which could be used with a more narrow flap 62. It will be appreciated that the invention encompasses the positioning of the flap on any part of the coat which will allow the folded or rolled coat to be surrounded by flap area.

Figure 12:
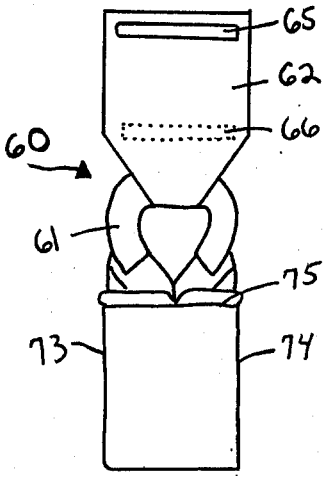

FIG. 12 illustrates that the more narrow bodyline of coat 60 can be folded in half before rolling the bottom 75 of the coat toward the flap 62. As illustrated, the bottom has been folded to meet the base of the collar. Folding the coat in this fashion will reduce the wrinkling of the front of the coat when the bottom is rolled toward flap 62. This is because the front of the coat is otherwise on the inside of the roll and traveling a shorter distance than the back of the coat and therefore becoming more wrinkled. The bottom of the coat could also be folded several times toward the top of the coat before it is rolled and secured to produce the same result.

Figure 13:
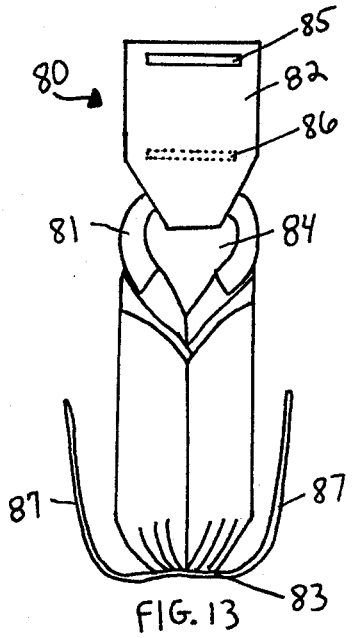
FIGS. 13 to 14 show how the drawstring of a garment can be utilized as a fastening device when the garment is in the rolled form.
Figure 14:
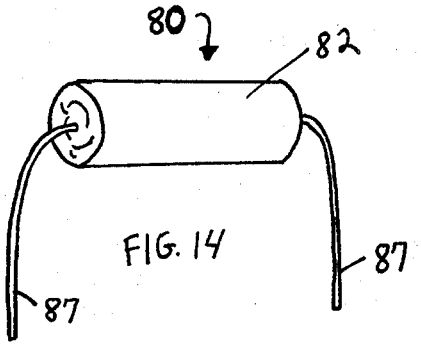

FIG. 13 shows coat 80 which is similar to coat 60, but including a drawstring 87 around the bottom 83 of the coat. Coat 80 also has collar 81, flap 82 and material adhesives 85 and 86 located on flap 82. FIG. 13 illustrates that the tightly pulled drawstring 87 causes most of the length of the string to be outside the more narrow bodyline. As illustrated by FIG. 14, when the garment is rolled to the top of flap 82, the string will extend from the side of the rolled garment and provide the user with a means of securing the compact shape to himself (such as tying it around his waist).

Figure 15:
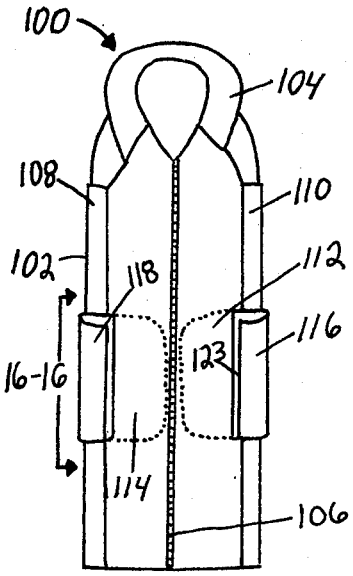
FIG. 15 is a front view of coat 100.

FIG. 15 illustrates coat 100, also without bulking lining. The sleeves have been folded inside the securable apparel side panel 102. Coat 100 includes collar 104 and zipper 106. Strips of material 108 and 110, similar to strips of material 12 and 14 illustrated on FIG. 1, run down the front of the coat and cooperate with strips of material (FIG. 16) which run down the back of the coat. Coat 100 also includes pockets 112 and 114. The entrance to the pocket flaps 116 and 118, respectively. Flaps 116 and 118 are folded back onto themselves. Flap 118 is permanently secured in position along edge 123 by complementary strips of pressure sensitive adhesive located between the folded portions as described above.

Figure 16:
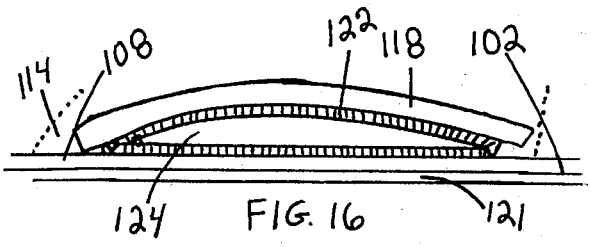
FIG. 16 is a side view of one of the pockets of coat 100.

FIG. 16 is a view of pocket 114 and shows zipper 122 located in the opening 124. Pocket 112 also has a zipper in its entrance (not shown).

Figure 17:
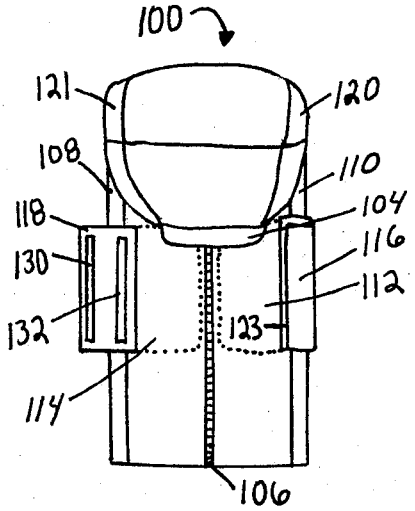
FIGS. 17–21 illustrate how the coat is folded to form a pocketbook or briefcase.
Figure 18:
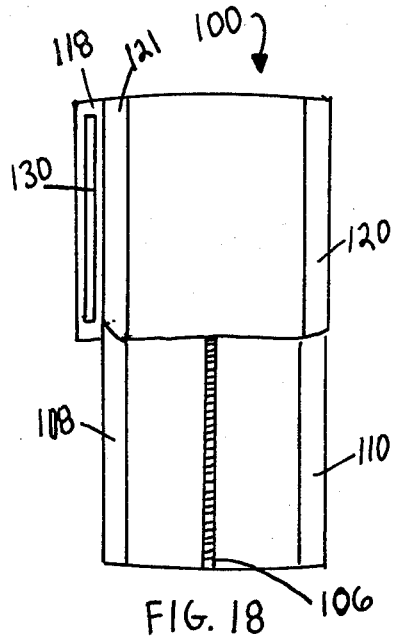
Figure 19:
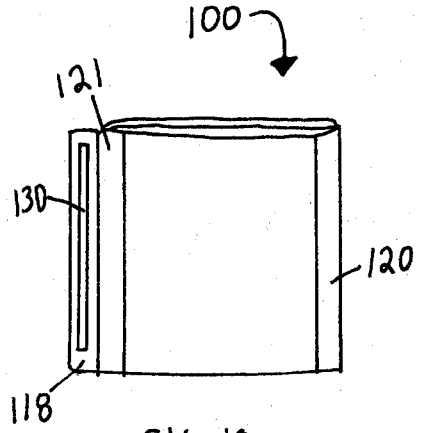
Figure 20:
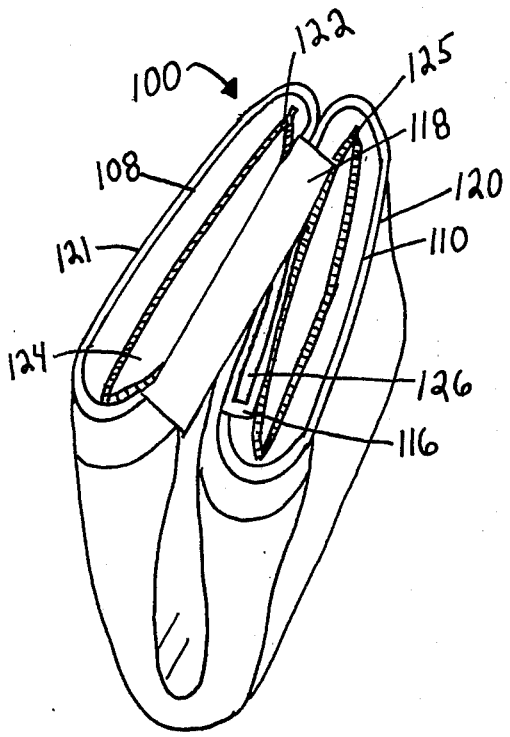

FIG. 17 shows the unfolded pocket flap 118 revealing the pressure sensitive adhesive strips 130 and 132 which secure the flap 118 in the folded position. The collar of coat 100 has been folded to the pocket region. FIG. 18 shows that the new top of coat 100 has been folded to the bottom of the pocket region. FIG. 20 shows that the bottom of the coat has been folded to meet the top of the pocket region.

Figure 21:
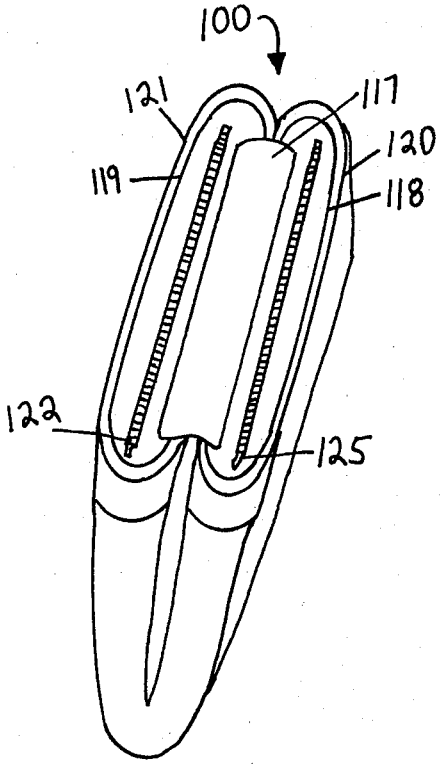

Referring to FIG. 21, the resulting shape is folded in half so that the entrance to each pocket may be attached to each other via flaps 116 and 118. The pockets may be secured to one another by a flap positioned elsewhere on the compacted unit. Behind flap 116 is a strip of pressure sensitive adhesive complementary to that located between flap 118. The adhesive 126 behind flap 116 attaches to the adhesive located on the outer edge of flap 118 when it is opened.

FIG. 21 illustrates the resulting shape when the pocket flaps are secured to one another. The resulting shape can be utilized with a strap so that it can be carried over the user's shoulder.

Figure 22:
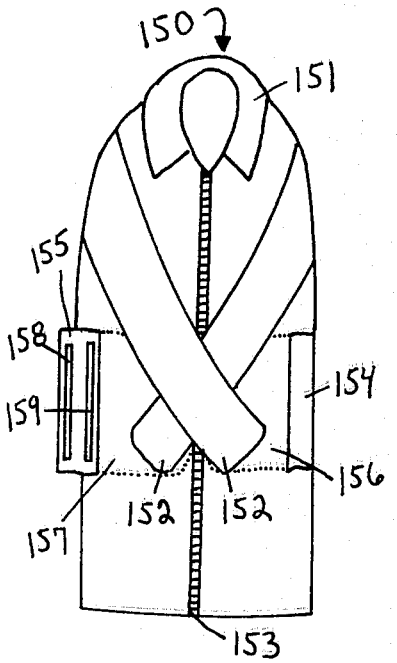
FIG. 22 is a front view of coat 150 which also can be folded into a pocketbook or briefcase.

FIG. 22 illustrates coat 150 which does not have a securable apparel side-body. Pockets 156 and 157 extend to the side seams of the coat. At the entrance to the pockets are pocket flaps 154 and 155 similar to pocket flaps 116 and 118 illustrated in FIG. 15. The coat 150 can also be folded by the process illustrated in FIGS. 17–21 to form a pocketbook or a briefcase. Also visible in FIG. 22 are collar 151, zipper 153, sleeves 152—152 and adhesive strips 158 and 159.

Figure 23:
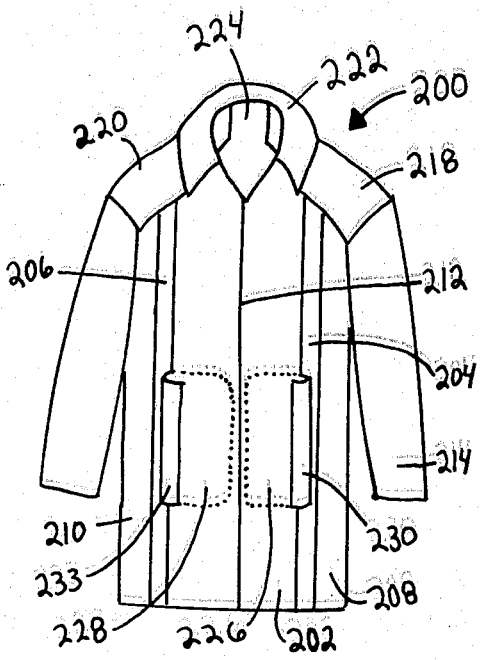
FIG. 23 shows a front view of a garment which can be formed into numerous compacted units.

Referring to FIG. 23, garment 200 illustrates a single garment which incorporates features by which it may be compacted into a roll, a pocketbook or cushion. This garment may be provided with a removeable lining. As previously described, garment 200 is fashioned with a front panel 202 which is bounded by flaps 204 and 206 and which cover fastening means 204′ and 206′ (not shown). The fastening means may be a pressure sensitive looped pile-strip arrangement or may be a zipper structure. Further, strips 204 and 206 may cover snap-type fasteners or any other conventional type of fastening means. Strips 204 and 206 delineate the bounds of front panel 202 and right and left side panels 208 and 210 respectively. The main fastening of the coat may be by a loop pile-strip, zipper or snap buttons as referred to at 212. Sleeves 214 and 216 extend from the uppermost area of side panels 208 and 210 respectively and further extend into shoulder regions 218 and 220 respectively.

Crowning the shoulder region is collar 222, a portion of which is integral with the uppermost section of the front panel 202. Roll flap 224 depends from a lower area of the inside of collar 222 but may be attached in that general area. Front panel 202 is constructed with pockets 226 and 228. Pockets 226 and 228 may be constructed so that the outer face thereof is a continuation of the front panel or layer over the front panel, which, in the latter instance, would be the inside of the pocket. Each of the pockets 226 and 228 is provided with fastening means 230 and 232 respectively which are necessarily placed on the pockets so that the garment can be folded between the strips (see FIG. 20). As such, the strips 230 and 232 may be placed near the outermost edge of a conventional pocket as illustrated in FIG. 23.

Figure 24:
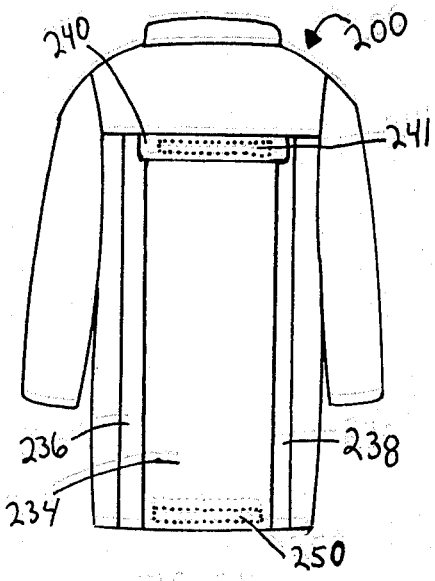
FIG. 24 shows a rear view of the garment of FIG. 23.

FIG. 24 depicts a rear view of garment 200 shown in FIG. 23 and clearly illustrates rear panel 234 which is bounded by fastening strips 236 and 238. The latter strips are complementary to the fastening strips 204 and 206, i.e. if a looped pile and mating strip arrangment is used, the looped pile may be in fastening strip 236′ while the mating strip may be in strip 204′ or vice versa. An additional fastening strip 241, covered by flap 240, bridges strips 236 and 238 and is preferably positioned at an uppermost section thereof.

Figure 25:
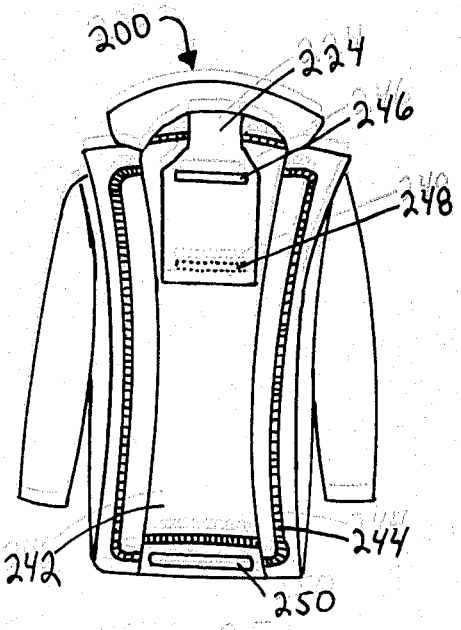
FIG. 25 shows a front view of the garment of FIG. 23 but in an opened position to reveal the inside thereof.

FIG. 25 shows garment 200 with the front panel 202 opened to reveal the inside 242 of the garment. It will be noted that garment 200 has provisions for an inner lining (not shown) in the form of an additional fastening means 244. This latter fastening device may be a conventional zipper or snap button arrangement. A bulky lining will be included when the user desires to compact the garment to a cushion type structure. However, the bulky lining is not included when one wishes to compact the garment to a roll or pocketbook. However, a thin lining may be included when forming the latter two structures.

FIG. 25 more clearly illustrates the construction of roll flap 224 which may be sewn or otherwise firmly affixed to inside 242 of garment 200. Likewise, roll flap 224 may be detachably affixed to the inside of the garment by a snap button, zipper or pile-strip arrangement. Roll flap 224 is produced to have at least two complementary fastening strips 246 and 248 thereon which preferably are on opposite faces of the roll flat. The distance between any pair of complementary fastening strips on the roll flap is the approximate circumference of the rolled up unit. As such, multiple pairs of complementary fastening strips allow one to adjust the diameter of the compacted rolled up unit. Further, inside 242 of garment 200 is fashioned with a strip 250 which mates with strip 241 (FIG. 24) when the unit is compacted to the cushion form.

When one desires to form the compacted unit as a roll or a pocketbook or a cushion, strips 204′ and 206′ will mate with strip 236′ and 238′. One may form the roll by mating the strips on the opposite faces of roll flap 224. Likewise, the roll may be formed as depicted by FIG. 7 and explained above.

Another procedure whereby the cushion may be formed relates to folding sleeves 214 and 216 into the front panel 202 and folding the lower section of the garment towards the collar area and attaching complementary fastening strips 241 to 250. Of course, the cushion may also be formed as depicted in FIGS. 1 to 6 and explained above.

The pocketbook compacted unit can be formed from garment 200 as depicted by FIGS. 15 to 21 and explained above.

Further, as an alternate means of fashioning a single garment which may be compacted in to a cushion or pocketbook or roll, the embodiment as illustrated in FIG. 7 may be modified by adding pockets such as 226 and 228 (FIG. 23) and complementary fastening strips 241 and 250 as described with reference to FIGS. 24 and 25.

The terms and expressions which have been employed are used as terms of description and not of limitation, and there is no intention in the use of such terms and expressions of excluding any equivalents of the features shown and described or portions thereof, it being recognized that various modifications are possible within the scope of the invention.

I claim:

1. A garment with securable apparel side panels, which comprises:

a set of securing members on the front of said garment substantially perpendicular to the hemline of said garment and located substantially at the midpoints between each respective side seam of said garment and the front center line of the garment and running downward substantially from the shoulder seam to the hemline of the garment, a complementary set of securing members on the back of said garment for the purposes of attaching to the set of securing members on the front of said garment substantially perpendicular to the hemline of said garment and located substantially at the midpoint between each respective side seam of said garment and the back center line of the garment and running downward substantially from the shoulder region to the hemline of said garment; so constructed and arranged that each side of the garment can be placed between the front and back sections of said garment and the complementary securing members on each respective side of the garment can be secured to one another and thereby secure the sides of said garment between the front and back sections.

2. The garment according to claim 1 wherein said securable apparel side panel is large enough to contain the sleeves of said garment after insertion of the respective sleeve portions therein.

3. The garment according to claim 1 wherein said securing members are made from cooperating strips of pressure sensitive adhesive.

4. The garment according to claim 1 wherein said garment also contains first and second attaching members located in a substantially parallel position and perpendicular to the securable apparel side panels so that the secured side panels can be folded and secured into a substantially rectangular shape for the purposes of being a pillow, cushion or easy-to-carry garment.

5. The garment according to claim 1 wherein said garment has two pockets with entrances which can be secured closed and located on the front or back section of the garment between the securing members and the front or back center line of the garment, and said pockets are provided with means to secure them in a substantially parallel location to one another after the side panels have been secured and the garment has been folded between the pocket areas.

6. A garment capable of being secured into either a cushion, a pocketbook, or rolled into an easy-to-carry garment, which comprises:

a removable lining;

securable apparel side panels;

first and second attaching members located on the back section of said garment in a substantially parallel position and perpendicular to the securable apparel side panels;

a set of two pockets with entrances which can be secured closed, and which are located on the front or back sections of the garment between the securing members of the securable apparel side panels and the front or back center line of the garment;

means to secure the pocket areas of said pockets in a substantially parallel location after the side panels have been secured and the garment has been folded between the pocket areas;

a flap member attached to said garment with securing members located on said flap member in a parallel position and at a distance approximately equal to the circumference of the rolled garment; so constructed and arranged that the garment can be secured into a cushion by securing the securable apparel side panels and attaching the first and second attaching members on the back of said garment, or rolled into an easy-to-carry garment by rolling the garment into a substantially cylindrical shape and securing the garment into said cylindrical shape by surrounding said cylindrical shape with the flap member and attaching the securing members located on the flap, or folded into a pocketbook when the lining is removed and the securable side panels are secured closed and the garment is folded between the pocket areas and the pockets are secured into a substantially parallel location to one another.

7. A garment capable of being rolled into a compact shape which comprises:

a flat flap member attached to the inside of the collar extending outward being the same width as the folded garment and having securing means positioned at a distance equal to the circumference of the rolled garment; so constructed and arranged that the garment can be rolled upon itself and surrounded by the flap member which thereby acts as a cover to encase the garment.

8. The garment according to claim 7 wherein said securing means are positioned on opposite sides of the flap in parallel location to one another.

9. The garment according to claim 7 wherein the garment has a drawstring bottom, said drawstring being capable of having its ends left outside the encased garment and thereby act as waistbelt or other tying means which the user can utilize to carry the compact shape.

* * * * *